US005310207A

United States Patent [19]

Stritzl et al.

[11] Patent Number: 5,310,207

[45] Date of Patent: May 10, 1994

[54] FRONT JAW

[75] Inventors: Karl Stritzl; Helmut Wladar, both of Vienna; Andreas Janisch, Oeyenhausen; Hubert Wuerthner, Hainburg/Donau, all of Austria

[73] Assignee: HTM Sport- und Freizeitgeraete Aktiengesellschaft, Schwechat, Austria

[21] Appl. No.: 955,745

[22] PCT Filed: Mar. 25, 1992

[86] PCT No.: PCT/EP92/00654

§ 371 Date: Dec. 14, 1992

§ 102(e) Date: Dec. 14, 1992

[87] PCT Pub. No.: WO93/04744

PCT Pub. Date: Mar. 18, 1993

[30] Foreign Application Priority Data

Aug. 28, 1991 [AT] Austria ..... 1686/91

[51] Int. Cl.[5] ..... A63C 9/085

[52] U.S. Cl. ..... 280/629; 280/634

[58] Field of Search ..... 280/625, 626, 628, 629, 280/633, 634

[56] References Cited

U.S. PATENT DOCUMENTS

| | | | |
|---|---|---|---|
| 5,028,069 | 7/1991 | Janisch et al. | 280/625 |
| 5,033,768 | 7/1991 | Stritzl | 280/625 |
| 5,193,841 | 3/1993 | Stritzl et al. | 280/625 |

FOREIGN PATENT DOCUMENTS

| | | |
|---|---|---|
| 0408855 | 1/1991 | European Pat. Off. . |
| 1938567 | 2/1971 | Fed. Rep. of Germany . |
| 2161861 | 6/1972 | Fed. Rep. of Germany . |

*Primary Examiner*—Brian L. Johnson

*Attorney, Agent, or Firm*—Flynn, Thiel, Boutell & Tanis

[57] ABSTRACT

A front jaw for a ski binding which prevents dirt from penetrating from above into a housing of the front jaw. The front jaw includes a release spring arranged within the housing. The release spring loads a pull rod extending through the spring, which pull rod acts through a release plate onto short lever arms of two toggle levers which are pivotal about vertical axes on a support part. Long lever arms of the toggle levers are designed as a sole holders for a ski boot. The support part has a through opening for the pull rod and a front support surface which rests at least partially on a rear cross wall of the housing. An insert plate is arranged between the support part and the rear cross wall of the housing and essentially rests on the rear cross wall and extends vertically, and on which insert plate the support part rests in certain areas. The insert plate includes upper side parts each having a first section of a first thickness and a second section extending upwardly from an upper extent of the first section and having a second thickness greater than the first thickness. The second section pivots about the first section in response to a pivotal movement of the support part. The second section when contacting the rear cross wall seals the housing from dirt penetration and provides a reliable bearing surface for further pivotal movements of the support part.

4 Claims, 2 Drawing Sheets

FRONT JAW

FIELD OF THE INVENTION

The invention relates to a front jaw which prevents dirt from penetrating into a housing from above.

BACKGROUND OF THE INVENTION

Such a front jaw is, for example, described in EP-A2 0 408 855.

The goal of the invention is to further improve this front jaw and, in particular, to keep dirt from penetrating into the open areas necessary for the movement of the holding plate.

It has already been suggested to build a ski binding with a housing closed on all sides (see DE-OS 19 38 567). However, this solution has the disadvantage that the structural possibilities with respect to the directions of movement are very limited. Such a solution is, therefore, out of the question for a front jaw with toggle levers of this type. It is furthermore known from DE-OS 21 61 861 to close off the open spaces between movable ski binding parts and the ski binding housing with a bellows. This solution was not successful in reality since such bellows could not withstand the rough operating conditions of a ski binding. Furthermore, such bellows are only suited for simple designs.

The invention has therefore the goal to avoid these disadvantages and to protect a front jaw of the above-mentioned type in a simple manner against the penetration of dirt from above. The designer should have at the same time greater freedom regarding material selection.

SUMMARY OF THE INVENTION

This purpose is attained according to present the invention. Due to the fact that following the rear crosswall of the housing there is arranged an insert plate extending vertically and essentially resting on the crosswall, on which plate rests in certain areas the front support surface of a support part, with the approximately horizontally rearwardly extending section following the plate at its upper section in an area adjacent to the longitudinal axis of the ski, the designer can select a suitable material for the plate independent from the housing. Due to the fact that upper side parts of the plate each have a section of a thin material thickness and a following section of a thicker material thickness, the open spaces needed for the movement of the support parts are closed off in an upward direction, with the first sections of a lesser material thickness being so flexible that the movement of the support parts is not influenced. The development enables a reliable bearing of the second section of the upper side parts of the plate on the support part even under unfavorable conditions.

BRIEF DESCRIPTION OF THE DRAWINGS

Further advantages, characteristics and details of the front jaw of the invention will now be described in greater detail in the drawings, in which.

DETAILED DESCRIPTION

Figure 1:
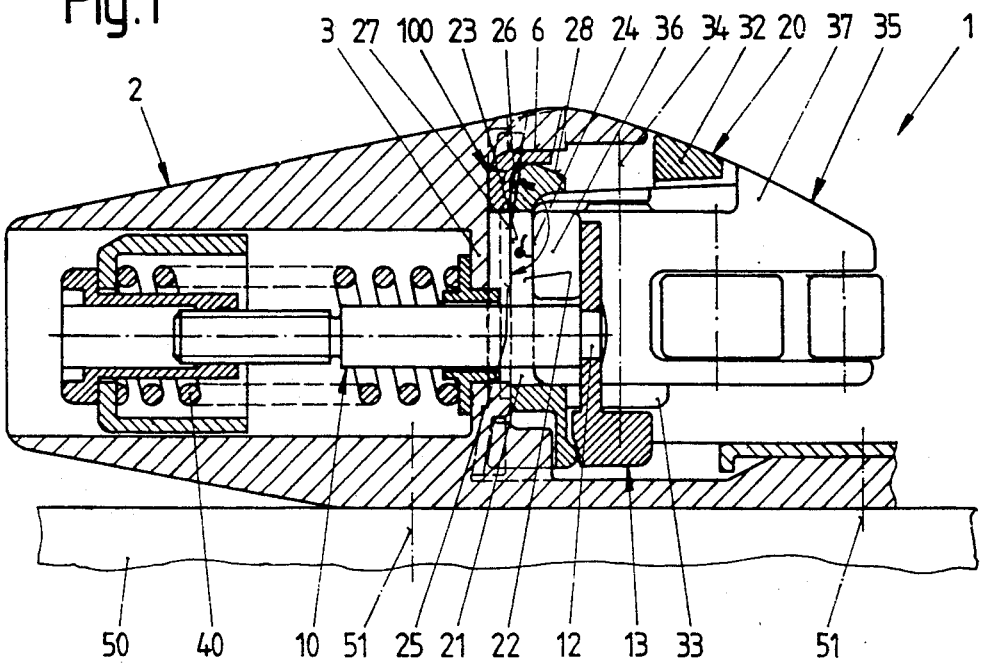
FIG. 1 is a longitudinal central cross-sectional view of the front jaw.
Figure 2:
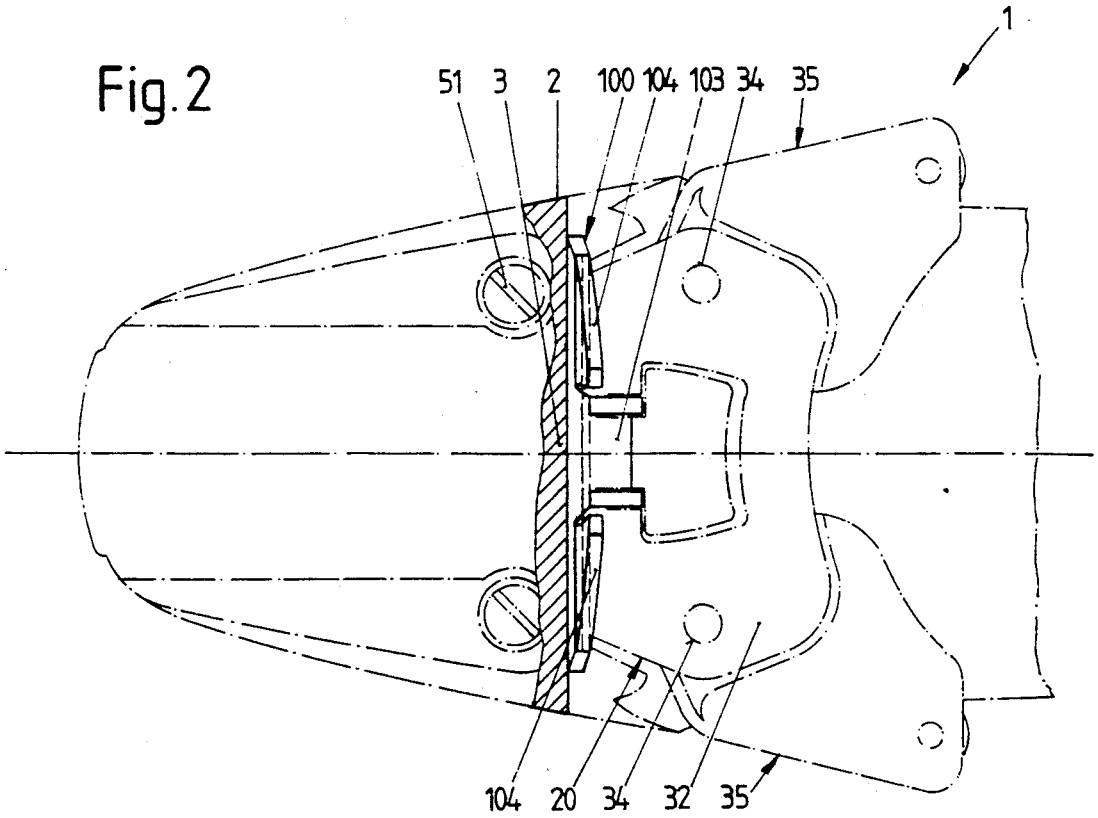
FIG. 2 is a fragmentary elevational top view thereof.

FIGS. 1 and 2 show the front jaw 1 of the invention in a position ready for stepping thereinto. FIG. 2 illustrates thereby for better clarity the parts not important to the invention only by dash-dotted lines. The front jaw has a housing 2 which is fastened on a ski 50 by means of screws 51 (only schematically indicated). A release spring 40 is housed in the housing 2. The release spring 40 is supported with its rear end on a vertically extending rear crosswall 3 of the housing 2. A pull rod 10 extends in axial direction through the rear crosswall 3. The rear end 12 of the pull rod 10 is connected to an essentially vertically extending release plate 13.

The vertically extending rear crosswall 3 of the housing 2 is followed at the top by a horizontally and rearwardly extending section 6. An insert plate 100 rests on the rear crosswall 3 of the housing. The insert plate 100 can be better recognized in FIGS. 3 and 4. It extends essentially vertically. A curved section 102 follows its upper section 101 in the area adjacent to the longitudinal axis of the ski, and the curved section is followed by an approximately horizontally rearwardly extending section 103. Upper side parts 104 of the insert plate 100 each have a first section 105 with a thin wall thickness and a second section 106 following thereafter with a greater wall thickness. The first section 105 has a thickness of between 0.5 mm and 1.5 mm in the illustrated exemplary embodiment.

A support part 20 with its support wall 22 rests in the position of the front jaw 1, in which it is ready to be stepped thereinto, on the back side of the insert plate 100. The support part 20 has the shape of a frame viewed from the rear, namely, it has a through opening 21 for the pull rod 10, and has—viewed in the side view—approximately the shape of a C. The vertically extending section of the C is formed by the support wall 22 and is equipped with a front support surface 23 and a rear support surface 24. Two axes 34 for toggle levers 35 are arranged symmetrically with respect to the central axis of the front jaw 2 in the upper and lower legs 32, 33 of the C. The shorter lever arms 36 of the two toggle levers 35 are supported on the one side thereof on the release plate 13 and on the other side thereof on the rear support surface 24 of the support part 20. The longer lever arms of the toggle levers 35 are designed as sole holders 37 to rest on the sole of a ski shoe. The front support surface 23 of the support part 20 has two sections 25, 26 adjacent one another in elevational direction, with the lower section 25, viewed in the position of the front jaw 2, in which it is ready to be stepped thereinto, resting on the back side of the insert plate 100. The upper section 26 defines an obtuse angle $\alpha$ with the lower section 25. Between the upper section 26 and the lower section 25, the support part 20 has a pivot edge 27. The upper leg 32 of the support part 20 has a rearwardly extending and downwardly inclined surface 28 in the area of the longitudinal central axis. The transition between the upper section 26 of the front support surface 23 and the rearwardly extending and downwardly inclined surface 28 is designed as a further curved section 29.

Figure 3:
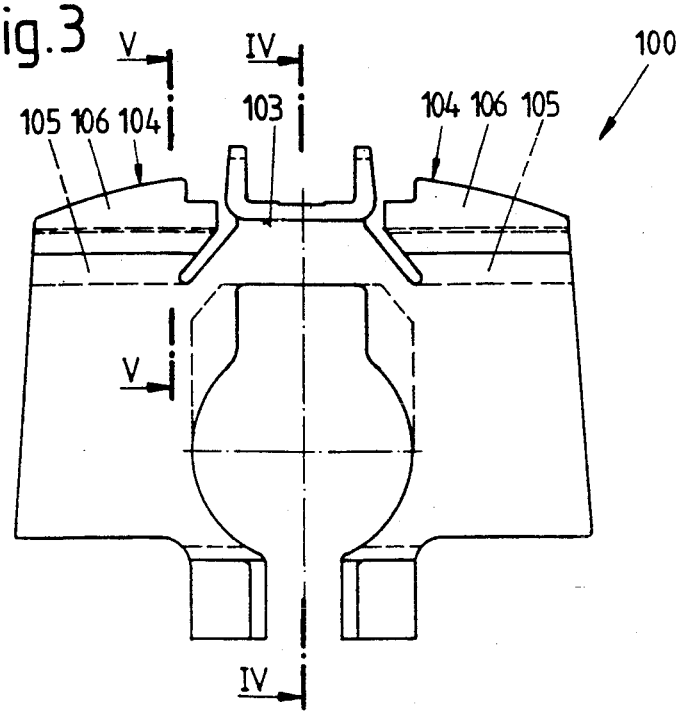
FIGS. 3 and 4 are an elevational view and a cross-sectional view respectively taken along the line IV—IV of the insert plate.
Figure 4:
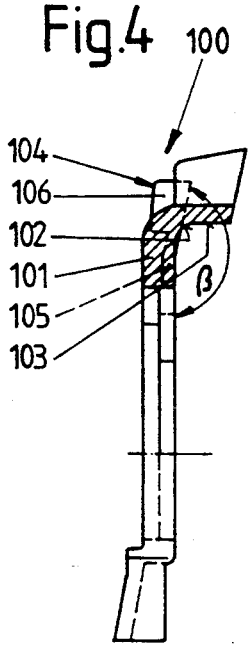
Figure 5:
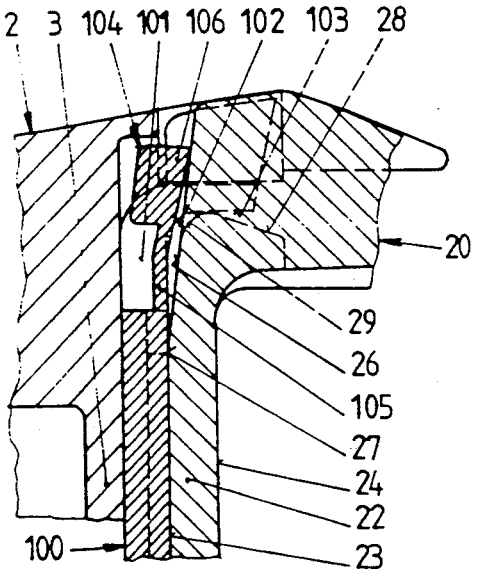
FIGS. 5 and 6 show a detail in an enlarged scale taken along the line V—V in FIG. 3.
Figure 6:
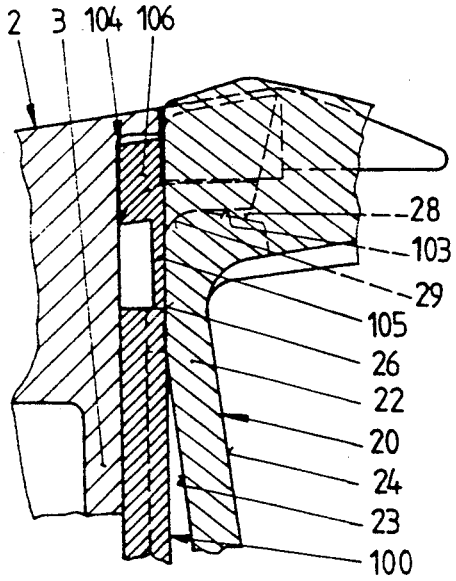

FIGS. 5 and 6 show an enlarged detail of the insert plate 100 in cross section along the line V—V of FIG. 3. It can thereby be recognized that the second section 106 of the upper side part 104 defines an obtuse angle $\beta$ with the first section 105. The angle $\beta$ is chosen such that the second section 106 rests in the assembled state with initial tension on the support part 20. One recognizes further that the second section 106 closes off in upward direction the open areas in the housing 2, which areas are needed for movement of the support part 20. Furthermore, the cooperation of the upper section 26, the curved section 29 and the rearwardly and downwardly inclined surface 28 of the support part 20 with the upper section 101 of the insert plate 100, the curved section 102 and the rearwardly extending section 103 during pivoting of the support part 20 can be recognized.

We claim:

1. In a front jaw for a ski binding including a housing adapted to be fastened to a ski and having a rear cross wall extending transverse to a longitudinal axis of the ski, the rear cross wall having a bore therethrough, an elongated pull rod disposed within the housing along the longitudinal axis and having one end of the pull rod extending through the bore, a release spring surrounding the pull rod within the housing to urge the pull rod along the longitudinal axis a release plate coupled to the end of the pull rod, two toggle levers each having a short lever arm and a long lever arm, the release plate operatively coupling the pull rod to the short lever arms and the long lever arms engaging a front end of a sole of a ski shoe, a support part having a through opening for the pull rod and a front surface support resting at least partially against a rear surface of the rear cross wall, the toggle levers being arranged pivotally on the support part, the improvement comprising an insert plate arranged between the rear cross wall and the support part, said insert plate including two spacedapart upper side parts and an approximately rearwardly extending central part interposed between said upper side parts in a direction transverse to the longitudinal axis, the upper side parts each including a first section having a first thickness in a direction along the longitudinal axis, and a second section extending upwardly from an upper extent of said first section and having a second thickness in said direction, said second thickness being greater than said first thickness to allow said section to pivot about said first section under the influence of the support part.

2. The front jaw according to claim 1, wherein said first thickness is in the range of about 0.5 mm to 1.5 mm.

3. In a front jaw for a ski binding including a housing adapted to be fastened to a ski and having a rear cross wall extending transverse to a longitudinal axis of the ski, the rear cross wall having a bore therethrough, an elongated pull rod disposed within the housing along the longitudinal axis and having one end of the pull rod extending through the bore, a release spring surrounding the pull rod within the housing to urge the pull rod along the longitudinal axis, a release plate coupled to the end of the pull rod, two toggle levers each having a short lever arm and a long lever arm, the release plate operatively coupling the pull rod to the short lever arms and the long lever arms engaging a front end of a sole of a ski shoe, a support part having a through opening for the pull rod and a front support surface resting at least partially against a rear surface of the rear cross wall, the toggle levers being arranged pivotally on the support part, the improvement comprising an insert plate arranged between the rear cross wall and the support part, said insert plate including two spaced-apart upper side parts and an approximately rearwardly extending central part interposed between said upper side parts in a direction transverse to the longitudinal axis, the upper side parts each including a first section having a first thickness in a direction along the longitudinal axis, and a second section having a second thickness in said direction, said second thickness being greater than said first thickness to allow said section to pivot about said first section under the influence of the support part, said first and second sections defining an obtuse angle with one another, and said second section abutting against the support part with an initial tension when in an assembled state.

4. The front jaw according to claim 3, wherein said first thickness is in the range of about 0.5 mm to 1.5 mm.

* * * * *